US011280136B2

(12) United States Patent
Brackin et al.

(10) Patent No.: US 11,280,136 B2
(45) Date of Patent: Mar. 22, 2022

(54) ROLLING DEPTH OF CUT CONTROLLER WITH CLAMSHELL RETAINER AND SOLID DIAMOND ROLLING ELEMENT

(71) Applicant: Halliburton Energy Services, Inc., Houston, TX (US)

(72) Inventors: Van Jordan Brackin, Spring, TX (US); Kelley Leigh Plunkett, The Woodlands, TX (US); Curtis Clifford Lanning, Montgomery, TX (US); John William Varner, The Woodlands, TX (US); Nicholas Grant Allison, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/943,760

(22) Filed: Jul. 30, 2020

(65) Prior Publication Data

US 2022/0034168 A1 Feb. 3, 2022

(51) Int. Cl.

| | |
|---|---|
| ***E21B 10/54*** | (2006.01) |
| ***E21B 10/43*** | (2006.01) |
| ***E21B 10/42*** | (2006.01) |

(52) U.S. Cl.

CPC ..... *E21B 10/54* (2013.01); *E21B 10/42* (2013.01)

(58) Field of Classification Search

CPC ..... E21B 10/43; E21B 10/54; E21B 10/14; E21B 10/46; E21B 10/62; E21B 10/55;

(Continued)

(56) References Cited

U.S. PATENT DOCUMENTS 5,715,898 A * 2/1998 Anderson ..... E21B 17/1057 175/325.3

9,976,353 B2 5/2018 Hinz et al.

(Continued)

FOREIGN PATENT DOCUMENTS

| | | |
|---|---|---|
| WO | 2017218000 | 12/2017 |
| WO | 2019152057 | 8/2019 |

OTHER PUBLICATIONS

U.S. Appl. No. 16/305,026 dated Nov. 27, 2018.

(Continued)

*Primary Examiner* — Daniel P Stephenson

(74) *Attorney, Agent, or Firm* — Thomas Rooney; C. Tumey Law Group PLLC

(57) ABSTRACT

A rolling depth of cut controller (DOCC) includes a first retainer including a body portion having an arcuate inner surface. The body portion extends partially around a central axis between the inner surface and an outer surface from a mating surface to an engagement surface. Further, the body portion extends axially along the central axis. The rolling DOCC also includes a second retainer secured to the first retainer at the mating surface via at least one fastening feature. Additionally, the rolling DOCC includes a rolling element disposed at least partially within a cavity formed between the first retainer and the second retainer. The rolling element is configured to rotate within the cavity about the central axis, and an exposed portion of the rolling element is configured to provide depth-of-cut control for a drill bit.

17 Claims, 6 Drawing Sheets

(58) Field of Classification Search
CPC . E21B 3/00; E21B 10/00; E21B 10/42; E21B 17/1057
See application file for complete search history.

(56) References Cited

U.S. PATENT DOCUMENTS

| | | | | |
|---|---|---|---|---|
| 10,066,439 | B2 | 9/2018 | Hinz et al. | |
| 10,494,876 | B2 * | 12/2019 | Mayer | E21B 17/1092 |
| 10,501,999 | B2 | 12/2019 | Grosz et al. | |
| 11,015,395 | B2 * | 5/2021 | Grosz | E21B 10/14 |
| 2006/0048973 | A1 | 3/2006 | Brackin et al. | |
| 2006/0162967 | A1 | 7/2006 | Brackin et al. | |
| 2008/0053709 | A1 * | 3/2008 | Lockstedt | E21B 10/55 175/426 |
| 2008/0142271 | A1 | 6/2008 | Brackin et al. | |
| 2008/0164062 | A1 | 7/2008 | Brackin et al. | |
| 2008/0202821 | A1 | 8/2008 | McClain et al. | |
| 2009/0217597 | A1 | 9/2009 | Brackin et al. | |
| 2010/0108401 | A1 | 5/2010 | Lanning et al. | |
| 2011/0192009 | A1 | 8/2011 | Plunkett | |
| 2012/0132471 | A1 * | 5/2012 | Zhang | E21B 10/627 175/338 |
| 2012/0312603 | A1 | 12/2012 | Propes et al. | |
| 2013/0105230 | A1 | 5/2013 | Brackin et al. | |
| 2013/0112486 | A1 | 5/2013 | Lanning et al. | |
| 2014/0151132 | A1 | 6/2014 | Brackin et al. | |
| 2014/0174827 | A1 | 6/2014 | Schen et al. | |
| 2016/0153243 | A1 * | 6/2016 | Hinz | E21B 10/633 175/57 |
| 2019/0249498 | A1 * | 8/2019 | Hinz | E21B 10/633 |
| 2019/0345768 | A1 | 11/2019 | Pregeant et al. | |
| 2020/0003013 | A1 * | 1/2020 | Ling | E21B 10/43 |
| 2020/0124100 | A1 | 4/2020 | Allison | |
| 2020/0318439 | A1 * | 10/2020 | Grosz | E21B 10/43 |
| 2020/0378190 | A1 * | 12/2020 | Grosz | E21B 10/43 |
| 2020/0399961 | A1 * | 12/2020 | Plunkett | E21B 10/567 |

OTHER PUBLICATIONS

U.S. Appl. No. 16/305,028 dated Nov. 27, 2018.
U.S. Appl. No. 16/329,329 dated Feb. 28, 2019.
U.S. Appl. No. 16/687,819 dated Nov. 19, 2019.

* cited by examiner

ROLLING DEPTH OF CUT CONTROLLER WITH CLAMSHELL RETAINER AND SOLID DIAMOND ROLLING ELEMENT

BACKGROUND

Various types of tools are used to form wellbores in subterranean formations for recovering hydrocarbons such as oil and gas lying beneath the surface. Examples of such tools include rotary drill bits, hole openers, reamers, and coring bits. One common type of rotary drill bit used to drill wellbores is known as a fixed-cutter drill bit. Generally, fixed-cutter drill bits include polycrystalline diamond ("PDC") cutters fixed to leading faces of the fix-cutter drill bit.

In conventional wellbore drilling, a fixed-cutter drill bit is mounted on the end of a drill string, which may be several miles long. At the surface of the wellbore, a rotary table or top drive may turn the drill string, including the drill bit arranged at the bottom of the hole to penetrate the subterranean formation. As the fixed-cutter drill bit rotates, the PDC cutters shear the subterranean formation. Over time, the working surface or cutting edge of each PDC cutter that continuously contacts the formation eventually wears down and/or fails. The fixed cutter drill bit may include one or more depth of cut controllers (DOCCs) to control the amount that the PDC cutters cut into the subterranean formation (e.g., depth of cut).

BRIEF DESCRIPTION OF THE DRAWINGS

These drawings illustrate certain aspects of some examples of the present disclosure and should not be used to limit or define the disclosure.

DETAILED DESCRIPTION

Disclosed are systems and methods for rolling depth of cut controllers (DOCCs) for a drilling operation. The rolling DOCCs are configured to be secured within corresponding slots provided on a drill bit. Each rolling DOCC is strategically positioned and secured to the drill bit so that a rolling element of the rolling DOCC is able to engage the formation during drilling in response to drill bit rotation. Rotation of the rolling element described herein may reduce friction at the interface between the drill bit and the formation, thereby allowing for a steady depth of cut and reducing a risk of stick-slip, whirl, or other conditions that may cause damage to the drill bit or hinder efficiency of drilling operations. As such, promoting rotation of the rolling element is beneficial to drilling operations. Common hinderances to rotation of rolling elements may include part misalignment, braze material interference, material sticking, etc. As set forth herein, the rolling DOCC reduces issues associated with these hinderances, such that the drill may operate with a steady depth of cut and reduce risk of conditions that negatively affect efficiency of drilling operations.

Figure 1:
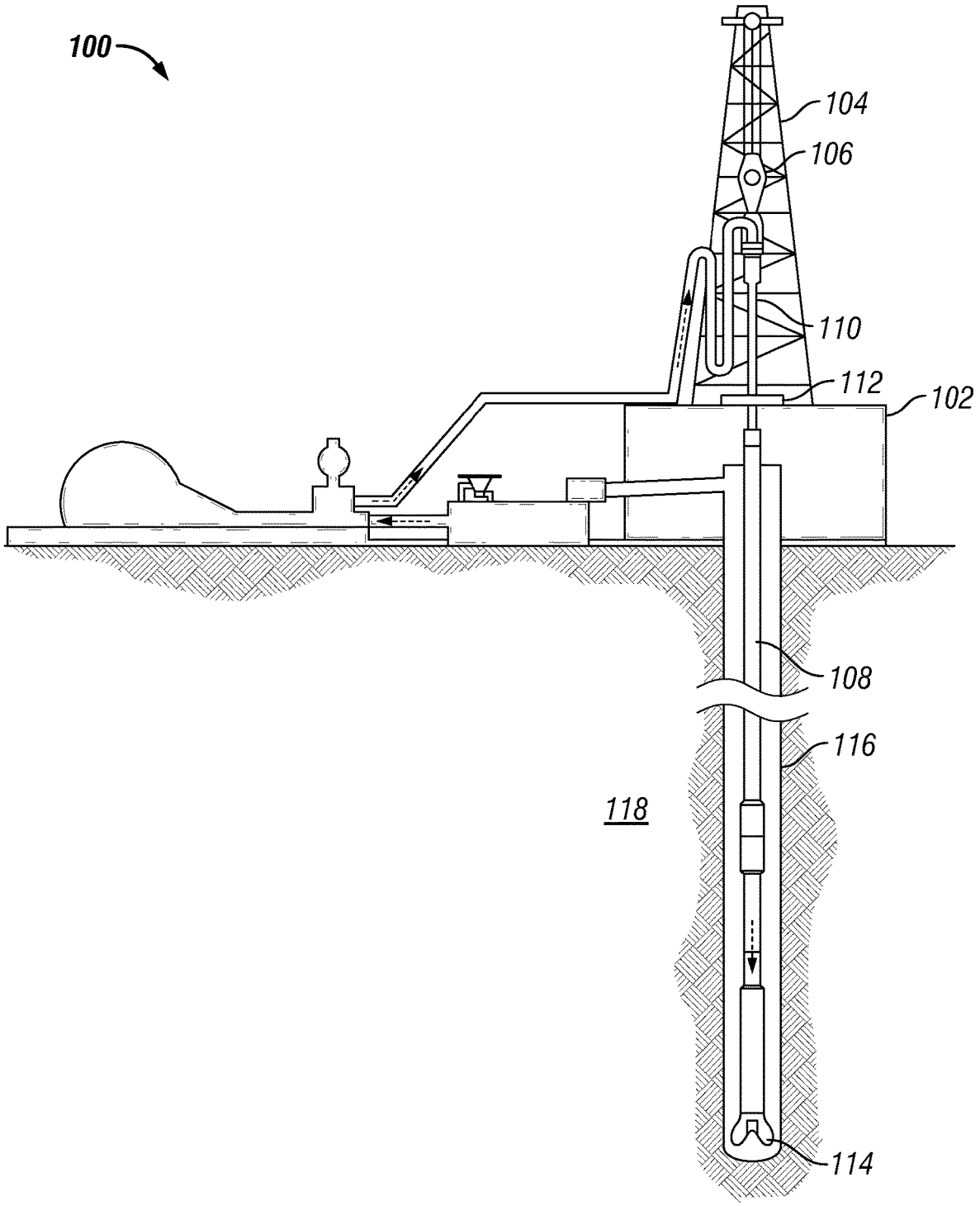
FIG. 1 illustrates a side elevation, partially cross-section view of an operational environment for a drilling system employing the principles of the present disclosure.

FIG. 1 is a side elevation, partial cross-section view of an operational environment for a drilling system in accordance with one or more embodiments of the disclosure. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 includes a drilling platform 102 that supports a derrick 104 having a traveling block 106 for raising and lowering a drill string 108. The drill string 108 includes, but is not limited to, drill pipe, as generally known to those skilled in the art. A kelly 110 is lowered through a rotary table 112 and can be used to transmit rotary motion from the rotary table to the drill string 108. A drill bit 114 is attached to the distal end of the drill string 108 and can be driven by a downhole motor and/or via rotation of the drill string 108. As the drill bit 114 rotates, it penetrates various subterranean formations 118 to create a wellbore 116. The drill bit 114 may be of a generally fixed-cutter type configuration, having a plurality of cutters at fixed locations on the bit body, as well as one of more rolling depth of cut controllers (DOCCs) for providing a steady cut into the subterranean formation 118 (e.g., a depth of cut) as further detailed below.

Figure 2:
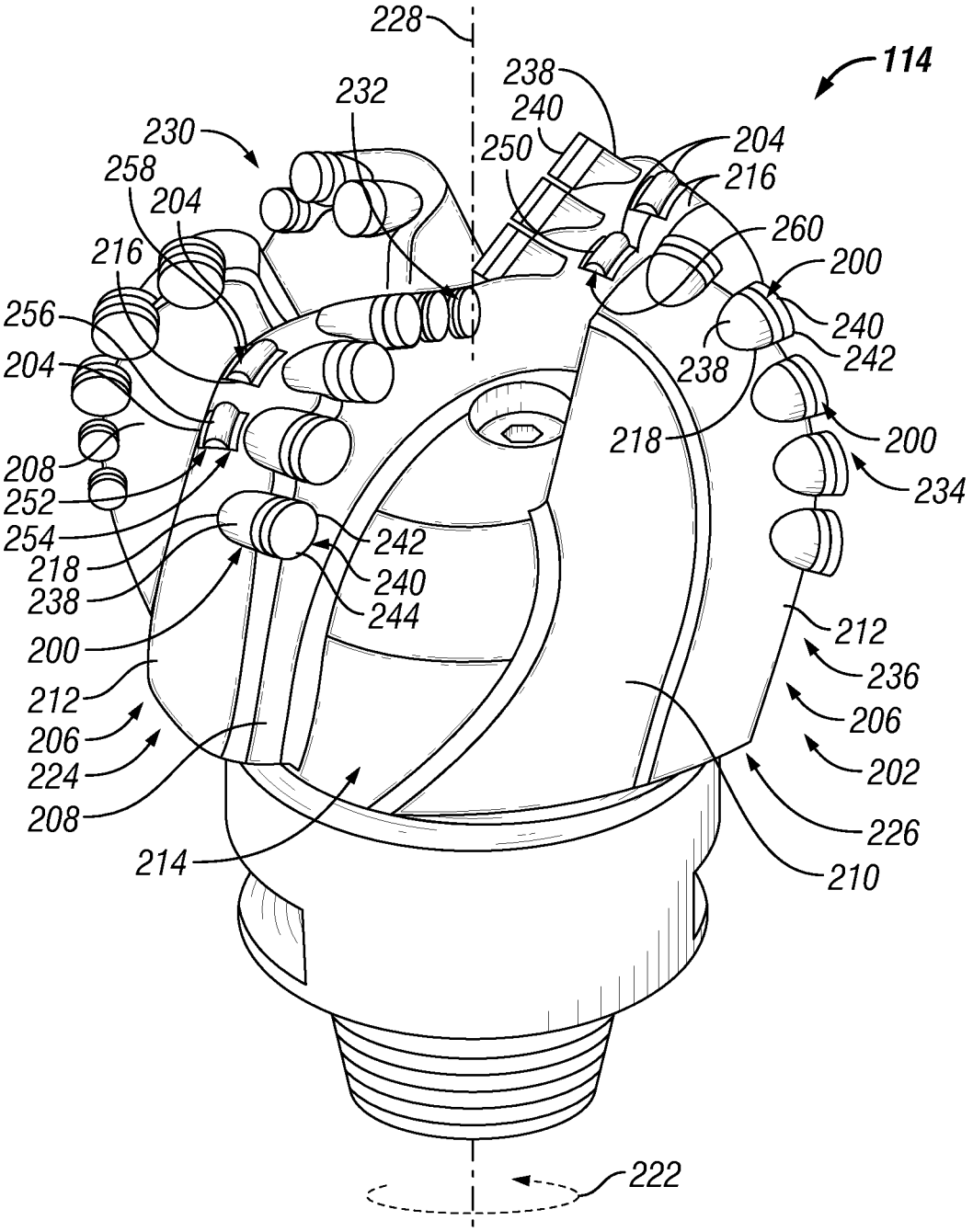
FIG. 2 illustrates an isometric view of an example of a drill bit employing the principles of the present disclosure.

FIG. 2 is an isometric view of an example of a drill bit 114 employing the principles of the present disclosure. The drill bit 114 has a plurality of cutting elements (e.g., fixed cutters 200) to penetrate various subterranean formations 118. Generally, the fixed cutters 200 are positioned about a bit body 202 of the drill bit 114 at particular locations and angular positions and may function to shear the various subterranean formations 118 (shown in FIG. 1) as drill bit 114 rotates. To remove or reduce the force applied to the fixed cutters 200 and limit their depth or engagement (i.e., provide depth of cut control), the drill bit 114 includes rolling DOCCs 204 positioned on the bit body 202. Each rolling DOCC 204 includes a retainer assembly 250 having the first retainer and the second retainer. Further, the rolling DOCC 204 includes a rolling element 256 disposed at least partially within a cavity 260 formed between the first retainer 252 and the second retainer 254 and is configured to rotate within the cavity during operation of the drill bit 114. The rolling DOCC 204 engages the subterranean formation 118 during operation of the drill bit 114. In particular, at least an exposed portion 258 of the rolling element 256 engages the subterranean formation 118 to remove or reduce the force applied to the fixed cutters 200 and limit their depth or engagement (i.e., provide depth of cut control). That is, as the rolling element 256 engages the subterranean formation 118, the rolling element 256 may rotate within the retainer assembly 250, which is secured to the drill bit 114, to reduce the force applied to the fixed cutters 200 and/or drill bit 114, which may reduce a risk of stick-slip, whirl, or other conditions that may cause damage to the drill bit 114 or hinder efficiency of drilling operations.

Moreover, the rolling DOCC 204 may be oriented on the drill bit 114 to promote rotation of the rolling element 256. As the drill bit 114 rotates, contact with the subterranean formation 118 may cause the rolling element 256 to rotate within the cavity based at least in part on an orientation of the rolling element 256 with respect to a movement path of the drill bit 114. That is, an orientation of the rolling element 256 with respect to a movement path of the drill bit 114 may affect rotation of the rolling element 256. For example, having the rolling element 256 oriented toward a direction of rotation 222 of the drill bit 114 may cause the rolling element 256 to rotate, whereas, the rolling element 256 may not rotate when oriented in a direction transverse to the direction of rotation 222 of the drill bit 114. As illustrated, the rolling DOCCs may be oriented toward the direction of rotation 222 of the drill bit 114, causing the rolling elements 256 to roll along the formation engaged by the drill bit 114 such that the rolling elements 256 may provide depth of cut control and prevent stick-slip and/or other undesirable conditions for the drilling operation. Alternatively, at least one rolling DOCC 204 may be oriented in the bit body 202 partially transverse to the direction of rotation 222 of the drill bit 114 to control an amount of rotation of the corresponding at least one rolling element 256.

As illustrated, the bit body 202 of the fixed-cutter drill bit 114 includes radially and longitudinally extending blades 206. The bit body 202, including the blades 206, may be made of a steel or metal-matrix composite of a harder material (e.g., tungsten carbide reinforcing particles dispersed in a binder alloy). The blades 206 have leading faces 208 oriented toward a direction of rotation of the drill bit 114, trailing faces 210 oriented opposite the direction of rotation of the drill bit 114, and exterior faces 212 oriented outward with respect to the bit body 202. The blades 206 are spaced apart from each other on die exterior of the bit body 202 to form fluid flow paths (e.g., junk slots 214) between leading faces 208 and trailing faces 210 of adjacent blades 206.

The blades 206 include various cutter pockets 218 and retainer slots 216 formed in the exterior faces 212, the leading faces 208, and/or the trailing faces 210 of the blades 206. As illustrated, the rolling DOCCs 204 are secured within corresponding retainer slots 216 formed in the exterior 212 and/or trailing faces 210 of the blades 206. The rolling DOCCs 204 are positioned on the blades 206 to trail the fixed cutters 200. However, the retainer slots 216 and corresponding rolling DOCCs 204 may be positioned on any portion of the bit body 202. Moreover, each retainer slot 216 is shaped and positioned to receive a retainer assembly 250 (e.g., a first retainer 252 and a second retainer 254) of a respective rolling DOCC 204, such that the rolling DOCCs 204 are at least partially secured within respective retainer slots 216. The retainer assemblies 250 may be at least partially secured within the retainer slots 216 via brazing, welding, threading, shrink-fitting, and/or press-fitting, an industrial adhesive, a mechanical fastener or any other suitable technique.

Moreover, the blades 206 of the drill bit 114 include at least one primary blade 224 and at least one secondary blade 226. The primary blade 224 extends from a central axis 228 of the drill bit 114. The secondary blade 226 includes any other blade 206 of the drill bit 114 that does not extend from the central axis 228 of the drill bit 114. Although the illustrated embodiment shows the drill bit 114 having two primary blades 224 and three secondary blades 226 by way of example, the drill bit 114 may include any number of primary blades 224 or secondary blades 226 insofar as those blades may be fit on the bit body 202. During drilling operations, the primary blade 224 may be configured to support a majority of the weight-on-bit. To control the depth of cut of the drill bit 114, the rolling DOCCs 204 are positioned on the primary blades 224. Alternatively, or additionally, one or more of the rolling DOCCs 204 may be positioned on the secondary blades 226.

Further, during drilling operations, a nose area 230 of the primary blades 224 may support the majority of the weight-on-bit. That is, the nose area 230 may support a greater portion of the weight-on-bit than a cone area 232, a shoulder area 234, or a gauge area 236 of the drill bit 114. To control the depth of cut of the drill bit 114, one or more of the rolling DOCCs 204 are disposed on or within the nose area 230 of the primary blades 224. Alternatively, the rolling DOCCs 204 may be disposed within any area of the drill bit 114. For example, the drill bit 114 may include rolling DOCCs 204 disposed within the cone area 232, the shoulder area 234, or the gauge area 236 of the bit body 202.

As set forth above, the blades 206 also include cutter pockets 218 formed in the exterior faces 212, the leading faces 208, and/or the trailing faces 210 of the blades 206. As illustrated, the fixed cutters 200 are secured within corresponding cutter pockets 218 formed in the leading faces 208 and/or exterior faces 212 of the blades 206. Each of the fixed cutters 200 will typically be secured within its respective cutter pocket 218 via brazing. Alternatively, the fixed cutters 200 may be secured at least partially within the respective fixed-cutter pocket 218 via threading, shrink-fitting, press-fitting, or any other suitable manufacturing or assembly method for fixedly securing the fixed cutters 200 to the bit body 202 such that the fixed cutter does not move with respect to the bit body 202 even while drilling. As set forth above, each of the fixed cutters 200 may be secured within the fixed-cutter pocket 218 at a predetermined angular orientation to position the fixed cutter 200 at a desired angle with respect to the subterranean formations 118 being penetrated. As the drill bit 114 is rotated, the fixed cutter 200 is driven through the subterranean formation 118 by the combined forces of the weight-on-bit and the torque experienced at the drill bit 114 to shear the various subterranean formations 118.

The fixed cutters 200 may each include a substrate 238 made of an extremely hard material (e.g., tungsten carbide) and a cutter 240 secured to the substrate 238. The fixed cutters 200 may each include one or more layers of an ultra-hard material, such as polycrystalline diamond, polycrystalline cubic boron nitride, impregnated diamond, etc., which generally forms a cutting edge 242 and a working face 244 for each cutter 240. The working face 244 is typically flat or planar. To form the cutter 240, the substrate 238 may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate.

Figure 3:
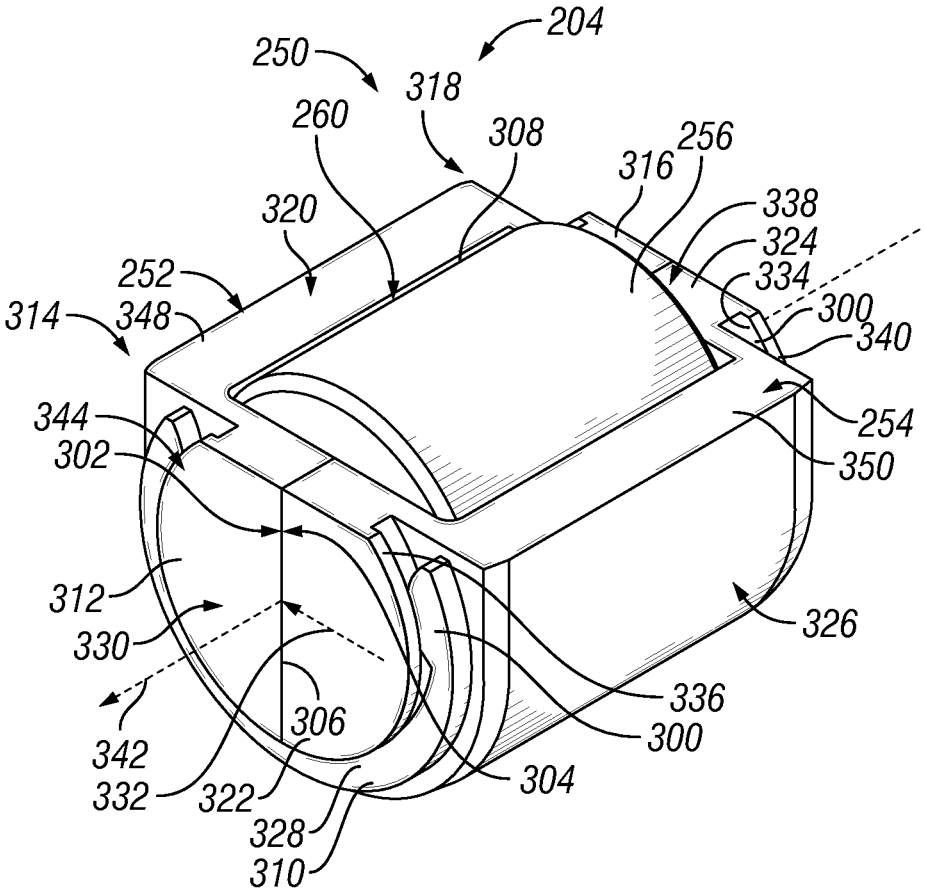
FIG. 3 illustrates an isometric view of an example of a rolling depth of cut controller (DOCC) employing the principles of the present disclosure.

FIG. 3 illustrates an isometric view of an embodiment of the rolling depth of cut controller (DOCC) 204 employing the principles of the present disclosure. As set forth above, the rolling DOCC 204 includes the first retainer 252 and the second retainer 254 secured together to form the retainer assembly 250 with the cavity 260 for housing the rolling element 256. In the illustrated embodiment, the first retainer 252 and the second retainer 254 are secured to each other via at least one fastening feature 300. Securing the first retainer 252 and the second retainer 254 to each other may include securing a first mating surface 302 of the first retainer 252 to a second mating surface 304 of the second retainer 254. In the illustrated embodiment, the first mating surface 302 may be secured to the second mating surface 304 to form a seal along an interface 306 between the two mating surfaces 302, 304. As set forth above, the rolling DOCC 204 may be brazed to the drill bit 114 during installation. Without securing and/or sealing the first retainer 252 to the second retainer 254, excess braze material from the brazing process may leak into the cavity 260 of the retainer assembly 250 through the interface 306 between the first retainer 252 and the second retainer 254. Having braze material in the cavity 260 may cause the rolling element 256 to catch against an inner surface 308 of the retainer assembly 250 or otherwise hinder rotation of the rolling element 256 with respect to the retainer assembly 250. As such, securing the first retainer 252 to the second retainer 254, via the at least one fastening feature 300, may reduce a risk of conditions hindering efficiency of the rolling DOCC 204.

The first retainer 252 may be secured to the second retainer 254 via any suitable fastening feature 300. Suitable fastening features 300 may include mechanical fasteners (e.g., circlips, screws, nuts, bolts, pins, rivets, etc.) and/or joined materials (e.g., materials joined via welding, brazing, gluing, soldering). In the illustrated embodiment, the first retainer 252 is secured to the second retainer 254 via a mechanical fastening feature 300. Specifically, the mechanical fastening feature 300 includes a pair of circlips (e.g., c-clips 310). The c-clips 310 are flexible metal rings with open ends that can be snapped over portions of the first retainer 252 and the second retainer 254 to hold the retainer assembly 250 together. The c-clips 310 may be made of a stainless steel material, a spring steel, or any suitable material.

As illustrated, the first retainer 252 and the second retainer 254 each include axial end portions extending out from respective body portions of the first retainer 252 and the second retainer 254. That is, the first retainer 252 has a first axial end portion 312 ending axial out from a first axial end 314 of a first body portion 320. Further, the first retainer 252 has a second axial end portion 316 extending out from an opposing axial end (e.g., a second axial end 318) of the first body portion 320. Similarly, the second retainer 254 has respective axial end portions (e.g., third axial end portion 322 and fourth axial end portion 324) extending out from opposite axial ends of a corresponding second body portion 326 of the second retainer 254.

In the illustrated embodiment, a first c-clip 328 is disposed around the axially aligned first axial end portion 312 and third axial end portion 322 of the respective first retainer 252 and second retainer 254. The first axial end portion 312 and the third axial end portion 322 may fit together to form a first fastener housing feature 330. The first fastener housing feature 330 may have a partially cylindrical shape configured to receive the first c-clip 328. During installation, the first c-clip 328 is slid over the first fastener housing feature 330, which may cause elastic deformation of the first c-clip 328. Once in place, the first c-clip 328 may exert a compressive force, based at least in part on an amount of elastic deformation of the first c-clip 328, on the first fastener housing feature 330 in a radially inward direction 332. The compressive force may be configured to hold the first axial end portion 312 against the third axial end portion 322, thereby, at least partially securing the first retainer 252 to the second retainer 254. Similarly, a second c-clip 334 may secure the second axial end portion 316 of the first retainer 252 to the fourth axial end portion 324 of the second retainer 254 to at least partially secure the first retainer 252 to the second retainer 254. In some embodiments, the c-clips 328, 334 may recover any elastic strain from installation after the c-clips 328, 334 are in place, such that the c-clip 328 may be configured to merely resist radial expansion/separation of the first axial end portion 312 and the third axial end portion 322.

Further, the first fastener housing feature 330 may include a first lip feature 336. Similarly, a second fastener housing feature 338 (i.e., formed from the second axial end portion 316 and the fourth axial end portion 324) may include a second lip feature 340. The lip features 336, 340 may be configured to prevent axial movement of the c-clips 328, 334 along the respective fastener housing features 330, 338. The c-clips 328, 334 may be positioned between the body portions 320, 326 of the retainers 252, 254 and the respective lip features 336, 340. As such, the lip features 336, 340 may prevent the c-clips 328, 334 from axially sliding in an axial direction 342 away from the retainer assembly 250, which may reduce a risk of c-clips 328, 334 detaching from retainer assembly 250 during manufacturing and/or installation processes. As illustrated, the respective axial end portions 312, 316, 322, 324 of the first retainer 252 and the second retainer 254 have variable (e.g., stepped) diameters. Specifically, distal ends (e.g., a first distal end 344 of the first axial end portion 312) of the respective axial end portions have greater diameters than proximal ends (e.g., a first proximal end 346 of the first axial end portion 312) of the respective axial end portions. The lip features 336, 340 may include the portions of the respective distal ends extending radially outward beyond the corresponding proximal ends of the respective axial end portions 312, 316, 322, 324. However, to reduce contact with the subterranean formation 118 (shown in FIG. 1), the lip features 336, 340 may not extend beyond portions of the respective proximal ends of the respective axial end portions at the respective engagement surfaces (e.g., a first engagement surface 348 and a second engagement surface 350) of the first retainer 252 and the second retainer 254.

Moreover, in the illustrated embodiment, the first retainer 252 and the second retainer 254 are identically shaped, such that the first retainer 252 and the second retainer 254 are interchangeable. Having identically shaped retainers may reduce manufacturing cost and provide for a simpler manufacturing process. Alternatively, the first retainer 252 and second retainer 254 may be asymmetric so long as the retainers (e.g., first retainer 252 and second retainer 254) fit together in a manner to form the seal along the interface 306 between the first retainer 252 and the second retainer 254 such that the braze material does not leak into the cavity 260 formed between the first retainer 252 and the second retainer 254.

Figure 4:
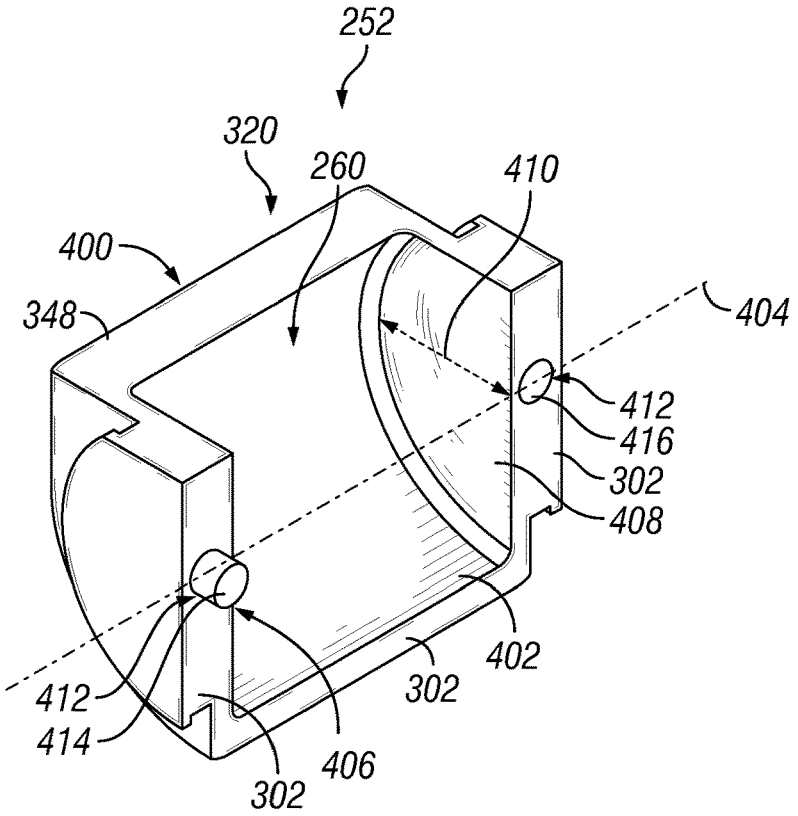
FIG. 4 illustrates an isometric view of an example of a split retainer of the DOCC of FIG. 3.

FIG. 4 illustrates an isometric view of an example of the first retainer 252 of the rolling DOCC 204. The first retainer 252 includes the first body portion 320 having radially outer surface 400 and an arcuate inner surface 402 extending along a central axis 404 from a first inner axial end 406 of the first body portion 320 to a second inner axial end 408 of the first body portion 320. The first body portion 320 (i.e., a shape of the first body portion 320) is partially extended around the central axis 404 between the arcuate inner surface 402 and the radially outer surface 400. A curvature of the arcuate inner surface 402 may be a radius of curvature with respect to the central axis 404, such that the curvature is based on a distance 410 of the arcuate inner surface 402 from the central axis 404. In some examples, the curvature of the arcuate inner surface 402 is substantially constant. Moreover, after installation of the rolling element 256, the first body portion 320 may share a similar central axis 404 with the rolling element 256 (shown in FIG. 3). The first body portion 320 extends around the central axis 404 from the first mating surface 302 to the first engagement surface 348, which form the edges of the first body portion 320. As set forth above, the first mating surface 302 is configured to engage the second mating surface 304 of the second retainer 254 (shown in FIG. 3). Moreover, the first engagement surface 348 is configured to be exposed to the wellbore 116 and may contact the subterranean formation 118 (shown in FIG. 2). To reduce wear during drilling operations, the first retainer 252 may comprise a hard material. For example, the first retainer 252 may include a tungsten carbide material. However, the first retainer 252 may include any suitable material.

The first retainer 252 and the second retainer 254 may be formed via any suitable manufacturing process. In particular, the first retainer 252 and the second retainer 254 may be formed via additive manufacturing (e.g., 3D printing). Generally, additive manufacturing can be a process for joining material to make an object from 3D model data. The additive manufacturing process may generate the object layer by layer via dispensing a liquified material over previously formed layers. Alternatively, the first retainer 252 and the second retainer 254 may be formed using a casting process. However, any suitable manufacturing process or combination of manufacturing processes may be used to form the first retainer 252 and the second retainer 254.

Moreover, as set forth above, the first retainer 252 is configured to be secured to the second retainer 254 to form the retainer assembly 250 (shown in FIG. 3). Indeed, the fastening feature 300 may urge (e.g., via a compressive force) the first mating surface 302 of the first retainer 252 into the second mating surface 304 of the second retainer 254 to form a seal along an interface 306 between the corresponding mating surfaces (shown in FIG. 3). As set forth above, the fastening feature 300 may be configured to urge and/or restrain movement of the first retainer 252 in a radial direction. However, to restrain axial movement of the first retainer 252 with respect to the second retainer 254, the first retainer 252 may include at least one interlocking feature. In the illustrated embodiment, the first retainer 252 has a first interlocking feature 412 comprising a pin 414 and a divot 416. The pin 414 and the divot 416 are disposed in the first mating surface 302. As illustrated, the pin 414 and the divot 416 may be disposed on opposite axial ends (e.g., the first inner axial end 406 and the second inner axial end 408) of the cavity 260. During installation/assembly, the pin 414 on the first mating surface 302 is positioned to align with a corresponding second interlocking feature (e.g. a divot) in the second mating surface 304 (shown in FIG. 3). Similarly, the divot 416 in the first mating surface 302 is positioned to align with a corresponding second interlocking feature (e.g., a pin) in the second mating surface 304 (shown in FIG. 3). As the first mating surface 302 and the second mating surface 304 are secured to each other first interlocking feature 412 may interlock with the second interlocking feature (i.e., the pins may interlock with their respective divots), which may restrain axial movement of the first mating surface 302 with respect to the second mating surface 304. Further, in some embodiments, the first and second interlocking features are configured to interlock to restrain at least two degrees of freedom between the first retainer 252 and the second retainer 254. For example, the interlocking features may restrain axial movement, as well as radial movement in a direction to the first mating surface 302 and the second mating surface 304.

Further, in some embodiments, the first mating surface 302 may have a plurality of pins, a plurality of divot, only pins, or only divots, and the second mating surface 304 may have corresponding pins and divots. In another example, the first mating surface 302 may have a first alignment recess and the second mating surface 304 may have a corresponding second alignment recess. The first and the second alignment recesses may both be configured to receive an alignment feature (e.g., an alignment pin, an alignment ball, etc.) configured to axially restrain the first retainer 252 and the second retainer 254. The alignment feature may include any suitable feature for aligning and axially restraining the first mating surface 302 with respect to the second mating surface 304.

Figure 5:
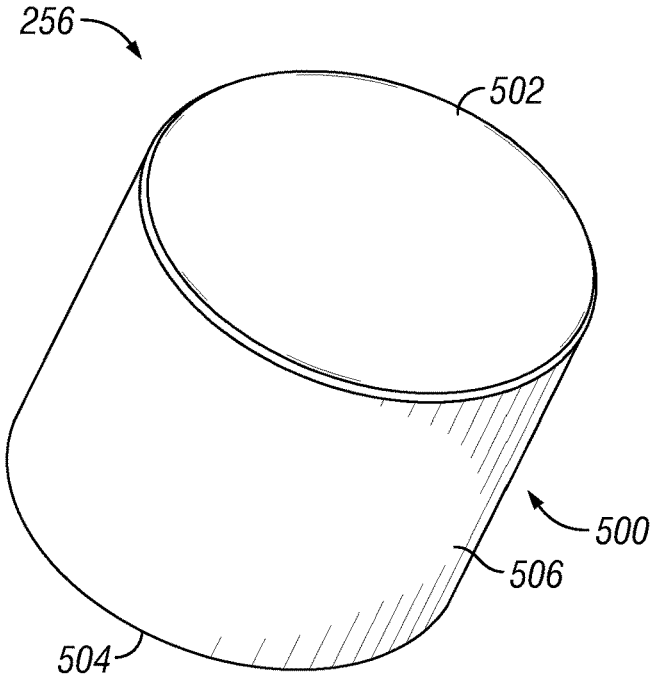
FIG. 5 illustrates an isometric view of an example of a solid diamond rolling element of the DOCC of FIG. 3.

FIG. 5 illustrates an isometric view of an example of a solid rolling element 256 of the rolling DOCC 204. As set forth above, the rolling element 256 is configured to roll with respect to the retainer assembly 250 during operation of the drill bit 114 (shown in FIG. 3). A shape of the rolling element 256 is based at least in part on a shape of the cavity 260 within the retainer assembly 250 (shown in FIG. 3). In the illustrated embodiment, the rolling element 256 has a substantially cylindrical shape 500, which may correspond to a retainer assembly 250 having a substantially cylindrical cavity 260. The substantially cylindrical shape 500 has a first axial end 502, a second axial end 504, and a radially outer surface 506. In some embodiments, the rolling element 256 has a hyperboloid shape, an oblate spheroid shape, a prolate spheroid shape, or any suitable shape for rotating within the retainer assembly 250.

As the rolling element 256 rotates, the rolling assembly is configured to contact and roll along the subterranean formation 118 (shown in FIG. 2). To minimize wear on the rolling element 256, the rolling element 256 may include a super hard material. In some embodiments, the rolling element 256 may comprise a hard material with a super hard material coating. However, in the illustrated embodiment, the rolling element 256 is a solid super hard material. For example, the rolling element 256 may be a solid diamond rolling element 256, the diamond comprising polycrystalline diamond, thermally stable polycrystalline diamond, cubic boron nitride, impregnated diamond, nanocrystalline diamond, ultra-crystalline diamond, zirconia, or any combination thereof.

Figure 6:
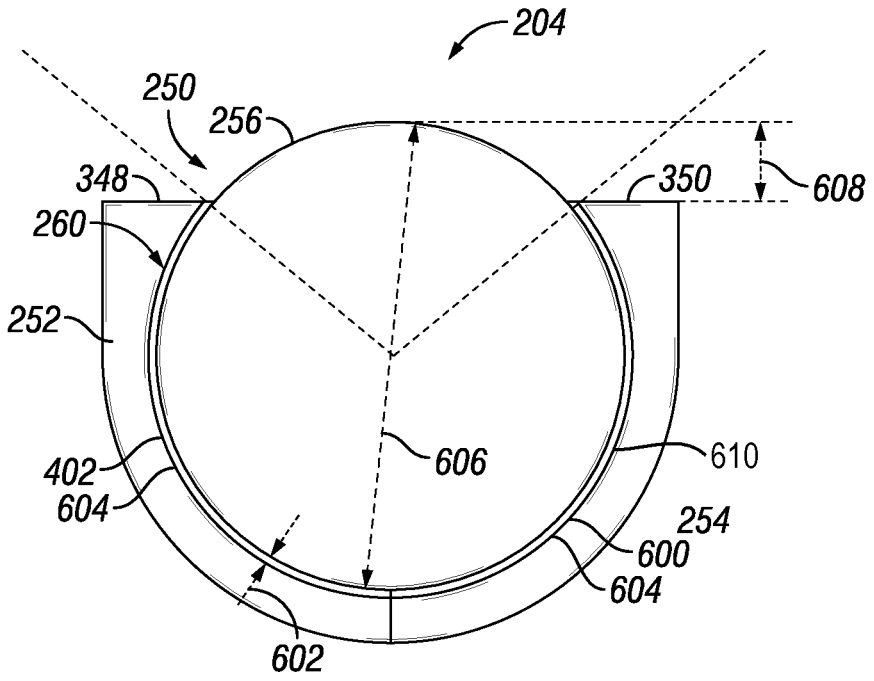
FIG. 6 illustrates a cross-sectional view of an example of a DOCC employing the principles of the present disclosure.

FIG. 6 illustrates a cross-sectional view of an embodiment of the rolling DOCC 204 employing the principles of the present disclosure. As illustrated, the rolling DOCC 204 includes the first retainer 252 and the second retainer 254 forming the retainer assembly 250 with the cavity 260 for housing the rolling element 256. The cavity 260 is formed between the respective arcuate inner surfaces (e.g., the first arcuate inner surface 402 and a second arcuate inner surface 600) of the first retainer 252 and the second retainer 254. The respective arcuate inner surfaces 402, 600 of the first retainer 252 and the second retainer 254 may have substantially constant radii of curvature such that the cavity 260 has a substantially circular shaped cross-section. The cavity 260 and the rolling element 256 may be correspondingly shaped to promote rotation of the rolling element 256. For example, the rolling element 256 may also have a substantially circular cross-section such that rolling element 256 may freely rotate within the cavity 260.

Having a sufficient radial clearance 602 (e.g., radial gap) between the inner surface 604 (e.g., arcuate inner surfaces 402, 600) of the retainer assembly 250 and the rolling element 256 may also promote rotation of the rolling element 256 within the cavity 260. Indeed, without the sufficient radial clearance 602, the rolling element 256 may bind against the inner surface 604 due to frictional forces. Thus, as illustrated, the radial clearance 602 between the rolling element 256 and the inner surface 604 of the retainer assembly 250 is sufficiently large to allow rotation of the rolling element 256 with respect to the retainer assembly 250. A minimum radial clearance 602 between the rolling element 256 and the arcuate inner surfaces 402, 600 may be 0.001 inches. Such radial clearance 602 may allow for rotation of the rolling element 256. Increasing the radial clearance 602 may further promote rotation of the rolling element 256. However, increasing the radial clearance 602 too much may allow the rolling element 256 to eject from the cavity 260, may reduce exposure of the rolling element 256 past the engagement surfaces 348, 350 of the retainer assembly 250, or may increase a risk of debris (e.g., cuttings, drilling mud, etc.) from the wellbore 116 entering into the cavity 260 and hindering rotation of the rolling element 256. A maximum radial clearance 602 may be based on a diameter 606 of the rolling element 256. In the illustrated embodiment, the maximum radial clearance 602 may be one tenth of the diameter of the rolling element 256.

Further, in some embodiments, the maximum radial clearance 602 may be based at least in part on a shape of the retainer assembly 250. The first retainer 252 and the second retainer 254 cooperatively encircle more than 180° but less than 360° of a circumference of the rolling element 256. In the illustrated embodiment, the first retainer 252 and the second retainer 254 cooperatively encircle between 255° and 285° of the rolling element 256. The retainer assembly 250 must encircle at least 180° of the rolling element 256 to prevent the rolling element 256 from ejecting during drilling operations. However, increasing the radial clearance above the minimum radial clearance between the rolling element 256 and the inner surface of the retainer assembly 250 may allow the rolling element 256 to eject from a retainer assembly 250 encircling only 180° of the rolling element 256. Increasing the amount that the retainer assembly 250 encircles the rolling element 256 may permit a greater maximum radial clearance 602. However, increasing the amount the retainer assembly 250 encircles the rolling element 256 may also decrease an exposure 608 of the rolling element 256.

The exposure 608 is the amount that the rolling element 256 extends outward from the engagement surfaces 348, 350 of the first retainer 252 and the second retainer 254. Having more exposure 608 may provide a greater amount of depth of cut control for the drill bit 114. Indeed, having a larger amount of exposure 608 may cause a larger portion of the rolling element 256 to engage the subterranean formation 118 (shown in FIG. 1) such that the rolling element 256 may more effectively remove or reduce the force applied to the fixed cutters 200 (shown in FIG. 2) and limit their depth or engagement. Further, in some embodiments, a particular depth of cut is required. When the rolling element 256 does not have sufficient exposure 608, the rolling DOCC 204 may only be partially seated within the retainer slot 216 to extend the rolling element 256 with respect to the surface of the drill bit 114 (shown in FIG. 2). However, this may require additional work to secure the rolling DOCC 204 (e.g., building up the blade 206 around the retainer assembly 250). As such, the rolling DOCC 204 may be manufactured with a sufficient amount of exposure 608 for desired drilling operations. For example, the amount of exposure 608 may be between 4% and 23% of the diameter 606 of the rolling element 256. However, as set forth above, the exposure 608 may be based at least in part on the amount that the retainer assembly 250 encircles the rolling element 256, which may be based at least in part on the radial clearance/gap 602 between the rolling element 256 and the inner surface 604 of the retainer assembly 250.

Moreover, the size of the radial gap 602 may be based at least in part on a coating 610 disposed between the rolling element 256 and the inner surface 604 of the retainer assembly 250. That is, when using the coating 610, the size of the radial gap 602 may be adjusted to accommodate the thickness of the coating 610. The coating 610 may be disposed along the entire radial gap 602 between the rolling element 256 and the arcuate inner surfaces 402, 600 of the first retainer 252 and the second retainer 254. In some embodiment, the coating 610 may only be applied to a portion of the radial gap 602 between the rolling element 256 and the arcuate inner surfaces 402, 600. The coating 610 may include a boron-nitride paint, a graphite foil, a zirconium oxide paint, titanium dioxide paint, a stop-off paint, or some combination thereof.

Figure 7:
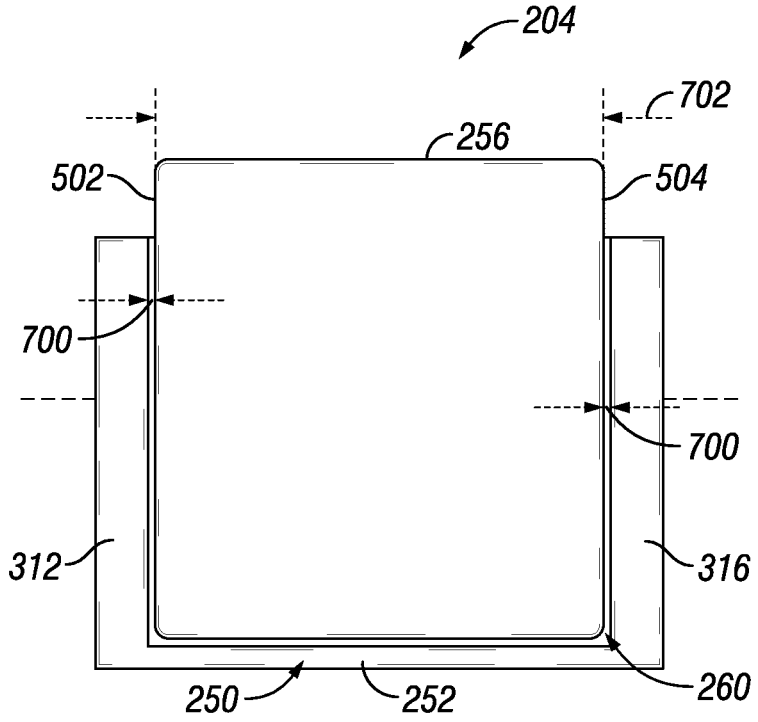
FIG. 7 illustrates a cross-sectional view of another example of a DOCC employing the principles of the present disclosure.

FIG. 7 illustrates a cross-sectional view of another example of the rolling DOCC 204 employing the principles of the present disclosure. As illustrated, the rolling DOCC 204 is disposed within the cavity 260 of the retainer assembly 250. The rolling element 256 extends between axial end portions of the retainer assembly 250. The rolling DOCC 204 may have a sufficient longitudinal clearance 700 between the axial ends (e.g., the first axial end 502 and the second axial end 504) of the rolling element 256 and respective axial end portions (e.g., first axial end portion 312 and second axial end portion 316 of the first retainer 252 and the second retainer 254 (shown in FIG. 3) to permit rotation of the rolling element 256 within the cavity 260. Without the sufficient longitudinal clearance 700, the axial ends 502, 504 of the rolling element 256 may bind against the retainer assembly 250 due to frictional forces.

A minimum longitudinal clearance 700 between the respective axial ends 502, 504 of the rolling element 256 and the retainer assembly 250 may be 0.001 inches. Such longitudinal clearances 700 may allow for rotation of the rolling element 256. Increasing the longitudinal clearance 700 may further promote rotation of the rolling element 256. However, increasing the longitudinal clearance 700 more than a maximum longitudinal clearance 700 may allow the rolling element 256 to slide axially within the cavity 260, which may negatively impact operation of the rolling DOCC 204. For example, the rolling element 256 may slide axially toward the second axial end portion 316 of the first retainer 252 of the retainer assembly 250, which may increase the longitudinal clearance 700 between the rolling element 256 and the first axial end portion 312 by such an amount that braze material (i.e., during installation) and/or debris (e.g., during operation) may enter into the cavity 260 and hinder rotation of the rolling element 256. In another example, having more longitudinal clearance 700 than the maximum longitudinal clearance may allow the rolling element 256 to slide within the retainer assembly 250 (shown in FIG. 2) away from an intended position with respect to the drill bit 114, such that the rolling element 256 fails to engage the subterranean formation 118 (shown in FIG. 1) as desired. In the illustrated embodiment, the maximum longitudinal clearance 700 between each axial end of the rolling element 256 and the respective axial end of the retainer assembly 250 may be one fourth of a length 702 of the rolling element 256.

Figure 8:
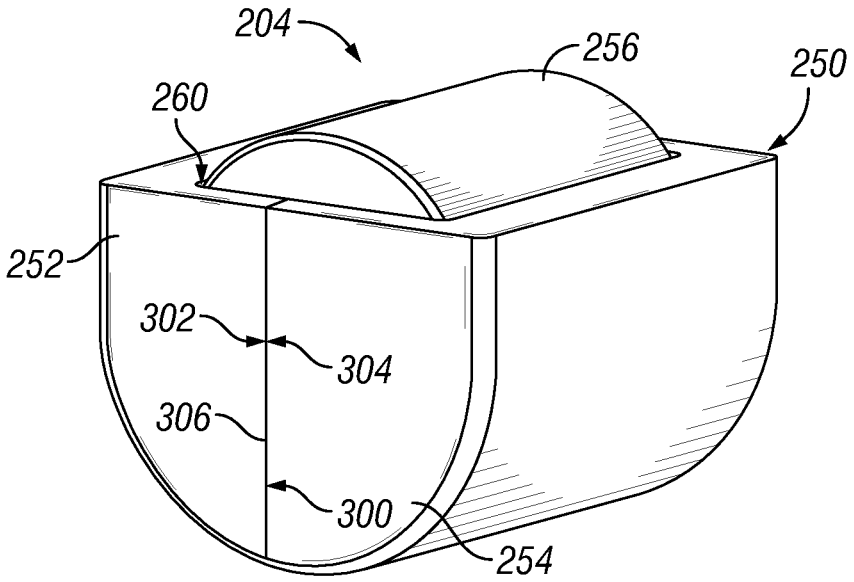
FIG. 8 illustrates an isometric view of another example of a DOCC employing the principles of the present disclosure.

FIG. 8 illustrates an isometric view of another example of the rolling DOCC 204 employing the principles of the present disclosure. The rolling DOCC 204 includes the rolling element 256 disposed within the cavity 260 formed between the first retainer 252 and the second retainer 254. As set forth above in FIG. 3, the first retainer 252 may be secured to the second retainer 254 via any suitable fastening feature 300. In the illustrated embodiment, the at least one fastening feature 300 includes joined materials. For example, the at least one fastening feature 300 may include a capacitive discharge weld configured to secure the first retainer 252 to the second retainer 254. Generally, a capacitive discharge welder uses capacitors to store energy that is rapidly discharged through work materials (e.g., the first retainer 252 and the second retainer 254) between electrodes of the welder to rapidly heat and cool the work materials, which may result in a capacitive discharge weld between the work materials. Thus, using a capacitive discharge welder to weld the first retainer 252 to the second retainer 254, a first electrode may be positioned to contact the first retainer 252 and a second electrode may be positioned to contact the second retainer 254. Upon activation, the capacitive discharge welder may discharge stored energy that may flow from the first electrode, through the first retainer 252, through the second retainer 254, and to the second electrode, thereby, melting the mating surfaces at the interface 306 between the first retainer 252 and the second retainer 254 along the path of the discharged energy. Upon solidifying, the first retainer 252 may be joined to the second retainer 254 at the interface 306 via a capacitive discharge weld. Multiple capacitive discharge welds may be used to secure the first retainer 252 to the second retainer 254. In some embodiments, the at least one fastening feature may include any type of weld (e.g., TIG, MIG, etc.).

Alternatively, the fastening feature 300 may include an epoxy disposed between the first retainer 252 and the second retainer 254. During installation, and epoxy may be applied to the first mating surface 302 and/or the second mating surface 304. During curing of the epoxy, the first mating surface 302 may be temporarily secured against the second mating surface 304 such that the epoxy may join the first retainer 252 to the second retainer 254. Moreover, as set forth above, any suitable fastening feature 300 may be used to secure the first retainer 252 to the second retainer 254 to seal the first retainer 252 to the second retainer 254 at the interface 306 and prevent braze from entering the cavity 260 during installation of the retainer assembly 250 into the drill bit 114 (shown in FIG. 2).

Figure 9:
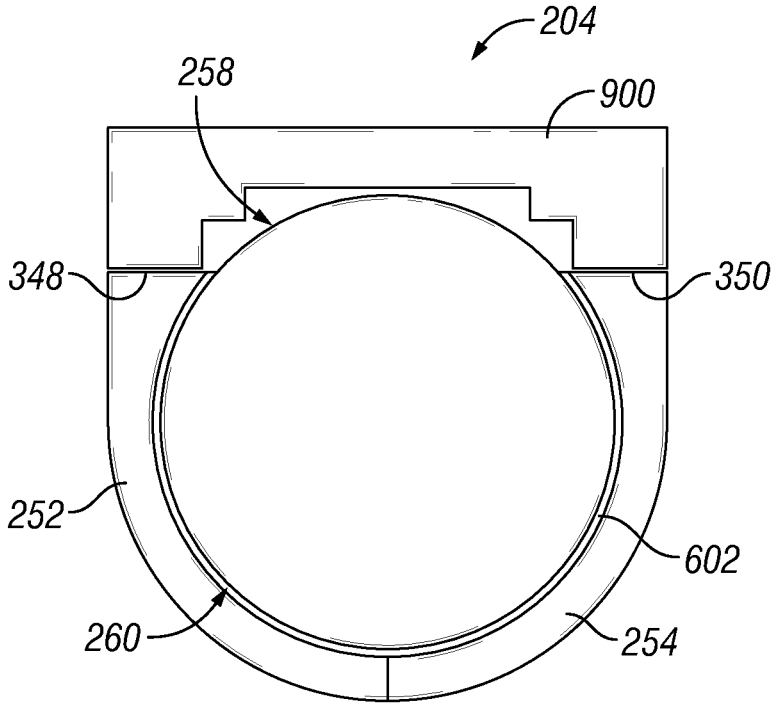
FIG. 9 illustrates a cross-sectional view of an example of a split retainer cap for a DOCC.

FIG. 9 illustrates a cross-sectional view of an example of a split retainer cap 900 for the rolling DOCC 204. The split retainer cap 900 may be attached to the retainer assembly 250 during installation. Specifically, the split retainer cap 900 may be attached to the retainer assembly 250 prior to brazing the retainer assembly 250 into the retainer slot 216 in the drill bit 114 (shown in FIG. 2). After brazing, the split retainer cap 900 is removed such that the exposed portion 258 of the rolling element 256 may engage the subterranean formation 118 (shown in FIG. 1). The split retainer cap 900 may be configured to prevent braze material from entering into the radial gap 602 and/or longitudinal gap proximate the respective engagement surfaces 348, 350 of the first retainer 252 and the second retainer 254. However, in the embodiments set forth above, the rolling DOCC 204 may be brazed into the retainer slot 216 without the use of the split retainer cap 900, as the design of the rolling DOCC 204 may reduce a risk of braze material entering into the cavity 260.

Accordingly, embodiments of the preceding description provide a drill bit having rolling depth of cut controller, for example, that provides depth of cut control for fixed cutters of the drill bit to reduce stick-slip or other issues that may damage parts of the drill string and/or hinder the efficiency of drilling operations. The systems, methods, and apparatus may include any of the various features disclosed herein, including one or more of the following statements.

Statement 1. A rolling depth of cut controller (DOCC) may comprise a first retainer including a body portion having an arcuate inner surface and an outer surface opposite the arcuate inner surface, the body portion extending partially around a central axis from a mating surface of the body portion to an engagement surface of the body portion, and wherein the body portion extends axially along the central axis; a second retainer secured to the first retainer at the mating surface via at least one fastening feature; and a rolling element disposed at least partially within a cavity formed between the first retainer and the second retainer, wherein the rolling element is configured to rotate within the cavity about the central axis, and wherein an exposed portion of the rolling element is configured to provide depth-of-cut control for a drill bit.

Statement 2. The rolling DOCC of statement 1, wherein the first retainer and the second retainer cooperatively encircle more than 180° but less than 360° of a circumference of the rolling element while leaving a full axial length of the rolling element exposed.

Statement 3. The rolling DOCC of any proceeding statement, wherein the second retainer and the first retainer are identically shaped.

Statement 4. The rolling DOCC of any proceeding statement, wherein the first retainer and the second retainer each include respective axial end portions protruding out from their respective body portions, wherein corresponding axial end portions of the first retainer and the second retainer are configured to receive the at least one fastening feature.

Statement 5. The rolling DOCC of any proceeding statement, wherein the at least one fastening feature comprises a first c-clip and a second c-clip, wherein the first c-clip is configured to secure the corresponding axial end portions at a first end of the first retainer and a first end of the second retainer to each other, and wherein the second c-clip is configured to secure corresponding axial end portions at a second end of the first retainer and a second end of the second retainer to each other.

Statement 6. The rolling DOCC of statements 1-4, wherein the at least one fastening feature includes a weld configured to secure the first retainer and the second retainer.

Statement 7. The rolling DOCC of statements 1-4, wherein the at least one fastening feature includes an epoxy disposed between the first retainer and the second retainer.

Statement 8. The rolling DOCC of any proceeding statement, wherein the arcuate inner surface comprises a constant inner radius.

Statement 9. The rolling DOCC of any proceeding statement, wherein the rolling element comprises a cylindrical shape, a hyperboloid shape, an oblate spheroid shape, or a prolate spheroid shape.

Statement 10. A drill bit may comprise a bit body; a plurality of blades disposed on the bit body and having a plurality of cutter pockets and a plurality of slots formed therein; a plurality of fixed cutters secured within the cutter pockets on the blades; a rolling depth of cut controller (DOCC) secured within a respective slot, the DOCC comprising: a first retainer including a body portion having an arcuate inner surface and an outer surface opposite the arcuate inner surface, the body portion extending partially around a central axis from a mating surface of the body portion to an engagement surface of the body portion, and wherein the body portion extends axially along the central axis; a second retainer secured to the first retainer at the mating surface via at least one fastening feature; and a rolling element disposed at least partially within a cavity formed between the first retainer and the second retainer, wherein rolling element is configured to rotate within the cavity about the central axis, and wherein an exposed portion of the rolling element is configured to provide depth-of-cut control for a drill bit.

Statement 11. The drill bit of statement 10, wherein the first retainer and the second retainer are secured within the respective slot via brazing, welding, an industrial adhesive, press fitting, shrink-fitting, a mechanical fastener, or some combination thereof.

Statement 12. The drill bit of statements 10-11, wherein the exposed portion of the rolling element extends outward from the engagement surfaces of the first retainer and the second retainer by four percent to twenty-three percent of a diameter of the rolling element.

Statement 13. The drill bit of statements 10-12, wherein a radial clearance gap between the rolling element and the arcuate inner surfaces of the first retainer and the second retainer is between one thousandth of an inch and one tenth of a diameter of the rolling element.

Statement 14. The drill bit of statements 10-13, further comprising a coating disposed between the rolling element and the arcuate inner surfaces of the first retainer and the second retainer, wherein the coating comprises a boron-nitride paint, a graphite foil, a zirconium oxide paint, a titanium dioxide paint, a stop-off paint, or some combination thereof.

Statement 15. The drill bit of statements 10-14, wherein the first retainer comprises a first interlocking feature and the second retainer comprises a second interlocking feature, wherein the first interlocking feature is configured to interlock with the second interlocking feature to restrain at least two degrees of freedom between the first retainer and the second retainer.

Statement 16. The drill bit of statements 10-15, wherein the first interlocking feature comprises a pin and the second interlocking feature comprises a divot, wherein the pin is disposed within the divot.

Statement 17. The drill bit of statements 10-16, wherein the first retainer comprises a first alignment recess and the second retainer comprises a second alignment recess, wherein the first alignment recess and the second alignment recess are configured to receive an alignment feature, and wherein the alignment feature comprises a ball or a pin.

Statement 18. A rolling depth of cut controller (DOCC) may comprise a retainer assembly having a first retainer and a second retainer, wherein each retainer includes a body portion having an arcuate inner surface and an outer surface opposite the arcuate inner surface, the body portion extending partially around a central axis from a mating surface of the body portion to an engagement surface of the body portion, wherein the body portion extends axially along the central axis, wherein a first axial end portion and a second axial end portion extend out from respective first and second axial ends of the body portion, and wherein the first retainer interfaces with the second retainer at the respective mating surfaces of the first retainer and the second retainer; a plurality of fastening features configured to secure the first retainer to the second retainer, the plurality of fastening features comprising a first c-clip and a second c-clip, wherein the first c-clip is configured to secure the first axial end portion of the first retainer to the first axial end portion of the second retainer, and wherein the second c-clip is configured to secure the second axial end portion of the first retainer to the second axial end portion of the second retainer; and a rolling element disposed at least partially within a cavity formed between the first retainer and the second retainer, wherein the rolling element is configured to rotate within the cavity about the central axis, and wherein an exposed portion of the rolling element is configured to provide depth-of-cut control for a drill bit.

Statement 19. The rolling DOCC of statement 18, wherein the rolling element is a solid diamond rolling element, wherein the diamond comprise polycrystalline diamond, thermally stable polycrystalline diamond, cubic boron nitride, impregnated diamond, nanocrystalline diamond, ultra-crystalline diamond, zirconia, or any derivatives thereof.

Statement 20. The rolling DOCC of statements 18-19, wherein the first retainer and the second retainer comprise a tungsten carbide material.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A rolling depth of cut controller (DOCC), comprising:

a first retainer including a body portion having an arcuate inner surface and an outer surface opposite the arcuate inner surface, the body portion extending partially around a central axis from a mating surface of the body portion to an engagement surface of the body portion, and wherein the body portion extends axially along the central axis;

a second retainer secured to the first retainer at the mating surface via at least one fastening feature, wherein the at least one fastening feature includes a weld configured to secure the first retainer and the second retainer, wherein the first retainer and the second retainer comprise a tungsten carbide material; and a rolling element disposed at least partially within a cavity formed between the first retainer and the second retainer, wherein the rolling element is configured to rotate within the cavity about the central axis, and wherein an exposed portion of the rolling element is configured to provide depth-of-cut control for a drill bit.

2. The rolling DOCC of claim 1, wherein the first retainer and the second retainer cooperatively encircle more than 180° but less than 360° of a circumference of the rolling element while leaving a full axial length of the rolling element exposed.

3. The rolling DOCC of claim 1, wherein the second retainer and the first retainer are identically shaped.

4. The rolling DOCC of claim 1, wherein the first retainer and the second retainer each include respective axial end portions protruding out from their respective body portions, wherein corresponding axial end portions of the first retainer and the second retainer are configured to receive the at least one fastening feature.

5. The rolling DOCC of claim 4, wherein the at least one fastening feature comprises a first c-clip and a second c-clip, wherein the first c-clip is configured to secure the corresponding axial end portions at a first end of the first retainer and a first end of the second retainer to each other, and wherein the second c-clip is configured to secure corresponding axial end portions at a second end of the first retainer and a second end of the second retainer to each other.

6. The rolling DOCC of claim 1, wherein the arcuate inner surface comprises a constant inner radius.

7. The rolling DOCC of claim 1, wherein the rolling element comprises a cylindrical shape, a hyperboloid shape, an oblate spheroid shape, or a prolate spheroid shape.

8. A rolling depth of cut controller (DOCC), comprising:

a first retainer including a body portion having an arcuate inner surface and an outer surface opposite the arcuate inner surface, the body portion extending partially around a central axis from a mating surface of the body portion to an engagement surface of the body portion, and wherein the body portion extends axially along the central axis;

a second retainer secured to the first retainer at the mating surface via at least one fastening feature;

a rolling element disposed at least partially within a cavity formed between the first retainer and the second retainer, wherein rolling element is configured to rotate within the cavity about the central axis, and wherein an exposed portion of the rolling element is configured to provide depth-of-cut control for a drill bit; and a coating disposed between the rolling element and the arcuate inner surfaces of the first retainer and the second retainer, wherein the coating comprises a boron-nitride paint, a graphite foil, a zirconium oxide paint, a titanium dioxide paint, a stop-off paint, or some combination thereof.

9. The drill bit of claim 8, wherein the first retainer and the second retainer are secured within the respective slot via brazing, welding, an industrial adhesive, press fitting, shrink-fitting, a mechanical fastener, or some combination thereof.

10. The drill bit of claim 8, wherein the exposed portion of the rolling element extends outward from the engagement surfaces of the first retainer and the second retainer by four percent to twenty-three percent of a diameter of the rolling element.

11. The drill bit of claim 8, wherein a radial clearance gap between the rolling element and the arcuate inner surfaces of the first retainer and the second retainer is between one thousandth of an inch and one tenth of a diameter of the rolling element.

12. The drill bit of claim 8, wherein the first retainer comprises a first interlocking feature and the second retainer comprises a second interlocking feature, wherein the first interlocking feature is configured to interlock with the second interlocking feature to restrain at least two degrees of freedom between the first retainer and the second retainer.

13. The drill bit of claim 12, wherein the first interlocking feature comprises a pin and the second interlocking feature comprises a divot, wherein the pin is disposed within the divot.

14. The drill bit of claim 8, wherein the first retainer comprises a first alignment recess and the second retainer comprises a second alignment recess, wherein the first alignment recess and the second alignment recess are configured to receive an alignment feature, and wherein the alignment feature comprises a ball or a pin.

15. A rolling depth of cut controller (DOCC), comprising:

a retainer assembly having a first retainer and a second retainer, wherein each retainer includes a body portion having an arcuate inner surface and an outer surface opposite the arcuate inner surface, the body portion extending partially around a central axis from a mating surface of the body portion to an engagement surface of the body portion, wherein the body portion extends axially along the central axis, wherein a first axial end portion and a second axial end portion extend out from respective first and second axial ends of the body portion, and wherein the first retainer interfaces with the second retainer at the respective mating surfaces of the first retainer and the second retainer;

a plurality of fastening features configured to secure the first retainer to the second retainer, the plurality of fastening features comprising a first c-clip and a second c-clip, wherein the first c-clip is configured to secure the first axial end portion of the first retainer to the first axial end portion of the second retainer, and wherein the second c-clip is configured to secure the second axial end portion of the first retainer to the second axial end portion of the second retainer; and a rolling element disposed at least partially within a cavity formed between the first retainer and the second retainer, wherein the rolling element is configured to rotate within the cavity about the central axis, and wherein an exposed portion of the rolling element is configured to provide depth-of-cut control for a drill bit.

16. The rolling DOCC of claim 15, wherein the rolling element is a solid diamond rolling element, wherein the diamond comprise polycrystalline diamond, thermally stable polycrystalline diamond, cubic boron nitride, impregnated diamond, nanocrystalline diamond, ultra-crystalline diamond, zirconia, or any derivatives thereof.

17. The rolling DOCC of claim 15, wherein the first retainer and the second retainer comprise a tungsten carbide material.

* * * * *